US010090598B2

(12) United States Patent
Uemichi

(10) Patent No.: US 10,090,598 B2
(45) Date of Patent: Oct. 2, 2018

(54) ANTENNA MODULE AND METHOD FOR MOUNTING THE SAME

(71) Applicant: FUJIKURA LTD., Tokyo (JP)

(72) Inventor: Yusuke Uemichi, Sakura (JP)

(73) Assignee: Fujikura Ltd., Tokyo (JP)

( * ) Notice: Subject to any disclaimer, the term of this patent is extended or adjusted under 35 U.S.C. 154(b) by 253 days.

(21) Appl. No.: 14/894,599

(22) PCT Filed: Mar. 3, 2015

(86) PCT No.: PCT/JP2015/056164
§ 371 (c)(1),
(2) Date: Nov. 30, 2015

(87) PCT Pub. No.: WO2015/133454
PCT Pub. Date: Sep. 11, 2015

(65) Prior Publication Data

US 2016/0126636 A1 May 5, 2016

(30) Foreign Application Priority Data

Mar. 3, 2014 (JP) ..... 2014-040914

(51) Int. Cl.
*H01Q 13/10* (2006.01)
*H01Q 13/18* (2006.01)
(Continued)

(52) U.S. Cl.
CPC ..... *H01Q 13/18* (2013.01); *H01P 5/107* (2013.01); *H01Q 21/0043* (2013.01)

(58) Field of Classification Search
CPC ..... H01Q 21/005; H01Q 1/38; H01Q 1/50; H01Q 13/10
(Continued)

(56) References Cited

U.S. PATENT DOCUMENTS

2002/0008665 A1* 1/2002 Takenoshita ..... H01P 3/121 343/700 MS
2006/0274992 A1* 12/2006 Shimura ..... H01P 5/08 385/14
(Continued)

FOREIGN PATENT DOCUMENTS

CN 102144289 A 8/2011
JP 2004-15160 A 1/2004
(Continued)

OTHER PUBLICATIONS

Uemichi, Y. et al, "A Simple Millimeter-wave Transformer between Microstrip Line and Post-Wall Waveguide", Microwave Conference Proceedings (APMC), 2013, pp. 411-413.
(Continued)

*Primary Examiner* — Dameon E Levi
*Assistant Examiner* — Collin Dawkins
(74) *Attorney, Agent, or Firm* — Westerman, Hattori, Daniels & Adrian, LLP

(57) ABSTRACT

An antenna module of the present invention is an antenna module 1 including a waveguide slot antenna (1A), a microstripline (1B), and an RFIC (16), the RFIC (16) being disposed to overlap a waveguide (123, 126) of the waveguide slot antenna (1A) as viewed in a stacking direction of layers. This provides an antenna module which can be mounted in a smaller area than a conventional antenna module.

6 Claims, 4 Drawing Sheets

(51) Int. Cl.
*H01P 5/107* (2006.01)
*H01Q 21/00* (2006.01)

(58) Field of Classification Search
USPC ..... 343/771, 846, 850, 772
See application file for complete search history.

(56) References Cited

U.S. PATENT DOCUMENTS

| | | | | |
|---|---|---|---|---|
| 2010/0245155 | A1* | 9/2010 | Miyazato ..... | G01S 7/032 342/104 |
| 2011/0163919 | A1 | 7/2011 | Suzuki | |
| 2011/0175793 | A1 | 7/2011 | Suzuki | |
| 2014/0126168 | A1 | 5/2014 | Fujita et al. | |
| 2014/0140031 | A1 | 5/2014 | Fujita et al. | |
| 2014/0145316 | A1 | 5/2014 | Fujita et al. | |
| 2015/0257254 | A1 | 9/2015 | Suzuki | |

FOREIGN PATENT DOCUMENTS

| | | | |
|---|---|---|---|
| JP | 2004-304611 | A | 10/2004 |
| JP | 2012-175624 | A | 9/2012 |
| WO | 2013/084496 | A1 | 6/2013 |

OTHER PUBLICATIONS

Office Action dated Dec. 28, 2016, issued in counterpart Chinese Application No. 201580000597.2. (8 pages).
International Search Report dated May 12, 2015, issued in counterpart application No. PCT/JP2015/056164 (1 page).
Decision of Refusal dated Dec. 24, 2014, issued in counterpart application No. JP2014-040914, w/English translation (6 pages).
Notification of Reasons for Refusal dated Sep. 24, 2014, issued in counterpart application No. JP2014-040914, w/English translation (9 pages).
Uemichi et al., "A Millimeter-wave Transformer between Microstrip Line and Flexible Post-Wall Waveguide on Liquid Crystal Polymer Substrates", IEEE, Jun. 2, 2013, pp. 1-4.
Hirokawa et al., "Problems in manufacturing techniques for realizing planar antenna for waveguide of high efficiency millimeter waves", <http://krpe.net/051003HIROKAWA.pdf>, Oct. 3, 2005, cited in the specification and ISR (35 pages).

* cited by examiner

ANTENNA MODULE AND METHOD FOR MOUNTING THE SAME

TECHNICAL FIELD

The present invention relates to an antenna module including a waveguide slot antenna and an RFIC (Radio Frequency Integrated Circuit) in an integrated manner. The present invention further relates to a method for mounting such an antenna module on a printed circuit board.

BACKGROUND ART

As a next-generation wireless LAN standard, WiGig (Registered Trademark) receives attention. The WiGig enables ultrahigh speed wireless communication at up to 6.75 G bits per second via a milli-meter wave of 60 GHz band. Thus, the demand for an antenna for 60 GHz band is considered to increase, because such an antenna is expected to be employed in commercial devices such as personal computers and smartphones, which have a large market size.

A typical example of the antenna for 60 GHz band is an antenna which is integrated with an RFIC. This is because that a high frequency signal of 60 GHz band is not suitable for wired transmission via a coaxial cable, since such a high frequency signal is easy to be attenuated. An antenna module including an antenna for 60 GHz band and an RFIC in an integrated manner is disclosed in, for example, Non-Patent Literature 1.

FIG. 5 is an exploded perspective view showing a configuration of an antenna module 5 disclosed in Non-Patent Literature 1. The antenna module 5 includes a first conductor layer 51, a first dielectric layer 52, a second conductor layer 53, a second dielectric layer 54, a third conductor layer 55, and an RFIC 56 which are stacked in this order.

According to the antenna module 5, the first conductor layer 51 and the second conductor layer 53, which face each other via the first dielectric layer 52, constitute a waveguide slot antenna 5A.

The first dielectric layer 52 includes (i) a power feeding pin 521, which serves as a TE mode excitation structure, and (ii) a plurality of posts 522 arranged so as to surround the power feeding pin 521 from four sides. The power feeding pin 521 is a non-through-hole (blind via) (i) extending from an upper surface of the first dielectric layer 52 to an inside of the first dielectric layer 52 and (ii) having an inner wall to which conductor plating is applied. The power feeding pin 521 has a lower end which is not in contact with the first conductor layer 51, and thus the power feeding pin 521 is electrically insulated from the first conductor layer 51. Further, in order to prevent an upper end of the power feeding pin 521 from coming into contact with the second conductor 53, the second conductor layer 53 has an opening (electrical conductor removed part) 531 (i.e., an anti-pad is achieved by a gap between the upper end of the power feeding pin 521 and the second conductor 53). Consequently, the power feeding pin 521 is electrically insulated also from the second conductor layer 53. Meanwhile, each of the posts 522 is a through-hole (i) extending from the upper surface of the first dielectric layer 52 to a lower surface of the first dielectric layer 52 and (ii) having an inner wall to which conductor plating is applied. Each of the posts 522 has (i) an upper end which is in contact with the second conductor layer 53 and (ii) a lower end which is in contact with the first conductor layer 53, and thus the first conductor layer 51 and the second conductor layer 53 are short-circuited to each other via the posts 522. With this arrangement, a region whose six sides are surrounded by the first conductor layer 51, the second conductor layer 53, and a post wall constituted by the plurality of the posts 522 functions as a waveguide 523 that guides an electromagnetic wave (TE mode) excited by the power feeding pin 521.

A high frequency signal outputted from the RFIC is transmitted through a microstripline 5B (described later) as an electromagnetic wave of TEM mode, and is then converted into an electromagnetic wave of TE mode by the power feeding pin 521. The electromagnetic wave is guided through the waveguide 523, and is then emitted outside the waveguide 523 via slots 511 formed in the first conductor layer 51. In contrast, an electromagnetic wave entering the inside of the waveguide 523 via the slots 511 formed in the first conductor layer 51 is guided through the waveguide 523 as an electromagnetic wave of TE mode, and is then converted into an electromagnetic wave of TEM mode by the power feeding pin 521. The electromagnetic wave is transmitted through the microstripline 5B (described later), and is then inputted to the RFIC 56 as a high frequency signal.

In the antenna module 5, the second conductor layer 53 and the third conductor layer 55, which face each other via the second dielectric layer 54, constitute the microstripline 5B.

The third conductor layer 55 is a conductor pattern printed on a surface of the second dielectric layer 54. The third conductor layer 55 includes a signal line 551, a signal pad 552, and a grounding pad 553. The signal line 551 is a linear electric conductor having one end which is connected to an upper end of a power feeding pin 541 formed in the second dielectric substrate 54. The power feeding pin 541 is a through-hole (i) extending from an upper surface of the second dielectric layer 54 to a lower surface of the second dielectric layer 54 and (ii) having an inner wall to which conductor plating is applied. The power feeding pin 541 has a lower end which is in contact with the upper end of the power feeding pin 521 formed in the first dielectric layer 52, and thus the signal line 551 and the power feeding pin 521 are electrically connected with each other via the power feeding pin 541. The signal pad 552 is a square planar electric conductor having a side which is connected to the other end of the signal line 551. Further, the grounding pad 553 is a square planar electric conductor disposed in the vicinity of the signal pad 552 but apart from the signal pad 552. The second dielectric layer 54 includes a grounding via 542 which is formed therein. The grounding via 542 is a through-hole (i) extending from the upper surface of the second dielectric layer 54 to the lower surface of the second dielectric layer 54 and (ii) having an inner wall to which conductor plating is applied. The grounding via 542 has (i) an upper end which is in contact with the grounding pad 553 and (ii) a lower end which is in contact with the second dielectric layer 53. With this arrangement, the second conductor layer 53 and the first conductor layer 51, which is short-circuited to the second conductor layer 53, have the same electric potential (grounding potential) as that of the grounding pad 533.

The signal pad 552 is connected with a signal terminal (not illustrated) formed on a back surface of the RFIC 56. Further, the grounding pad 553 is connected with a grounding terminal (not illustrated) formed on the back surface of the RFIC 56. This arrangement allows, in sending operation, a high frequency signal from the RFIC 56 to be inputted to the waveguide slot antenna 5A via the microstripline 5B. Further, the above arrangement allows, in receiving operation, a high frequency signal supplied from the waveguide slot antenna 5A can be inputted to the RFIC 56 via the microstripline 5B.

Note that, as those exemplified by the waveguide slot antenna 5A shown in FIG. 5, an antenna having a waveguide made of (i) two conductor layers facing each other and (ii) a post wall constituted by a plurality of posts laterally surrounding a region which is sandwiched by the two conductor layers is called a "post wall waveguide antenna". Such a post wall waveguide antenna is disclosed by, for example, Patent Literature 1. However, in referring to Patent Literature 1, please note the following point. That is, a post wall waveguide antenna disclosed in Patent Literature 1 is not such a waveguide slot antenna that electromagnetic waves are inputted and outputted via slots formed in a single one of the two conductor layers.

CITATION LIST

Patent Literature

Patent Literature 1

Japanese Patent Application Publication, Tokukai, No. 2012-175624 A (Publication Date: Sep. 10, 2012)

Non-Patent Literature

Non-Patent Literature 1

Jiro HIROKAWA, "Koukouritsu miriha douhagata heimen antena jitsugen no tame no seizougijutsuteki shomondai (Problems in manufacturing techniques for realizing planar antenna for waveguide of high efficiency millimeter waves)". (Online available from Feb. 3, 2014), URL on the Internet <http://krpe.net/051003HIROKAWA.pdf>

SUMMARY OF INVENTION

Technical Problem

However, according to the conventional antenna module 5 shown in FIG. 5, the RFIC 56 is disposed so as not to overlap the waveguide 523 as viewed in a stacking direction (i.e., a direction orthogonal to the layers). Consequently, an area of the antenna module 5 as viewed in the stacking direction, i.e., an area required for mounting the antenna module 5, is greater than a sum of (i) an area of the RFIC 56 as viewed in the stacking direction and (ii) an area of the waveguide 523 as viewed in the stacking direction.

The present invention has been made in view of the above problem, and it is an object of the present invention to provide an antenna module which is able to be mounted in a smaller area than the conventional antenna module 5.

Solution to Problem

In order to attain the object, an antenna module of the present invention includes: a waveguide slot antenna including a first conductor layer and a second conductor layer facing each other via a first dielectric layer, the first conductor layer having an opening serving as a slot; a microstripline including the second conductor layer and a third conductor layer facing each other via a second dielectric layer; and a radio frequency integrated circuit being connected to the third conductor layer, the radio frequency integrated circuit being disposed so as to overlap a waveguide in the waveguide slot antenna as viewed in a stacking direction of the layers.

According to the above arrangement, an area of the antenna module of the present invention as viewed in the stacking direction, i.e., an area required for mounting the antenna module of the present invention, is smaller than a sum of (i) an area of the RFIC as viewed in the stacking direction and (ii) an area of the waveguide as viewed in the stacking direction. That is, an area required for mounting the antenna module of the present invention is smaller than an area required for mounting a conventional antenna module.

Further, a method of the present invention for mounting an antenna module is a method for mounting the above-described antenna module on a printed circuit board, the method including the step of: bump-connecting the antenna module to the printed circuit board via a solder bump, the solder bump via which the antenna module is bump-connected to the printed circuit board having a height greater than a sum of (i) a thickness of the radio frequency integrated circuit and (ii) a height of a solder bump via which the radio frequency integrated circuit is bump-connected to the third conductor layer.

According to the above configuration, it is possible to mount the antenna module on the printed circuit board while preventing the RFIC from coming into contact with the printed circuit board.

Advantageous Effects of Invention

According to the present invention, it is possible to provide an antenna module which is able to be mounted in a smaller area than a conventional antenna module.

Figure 1:
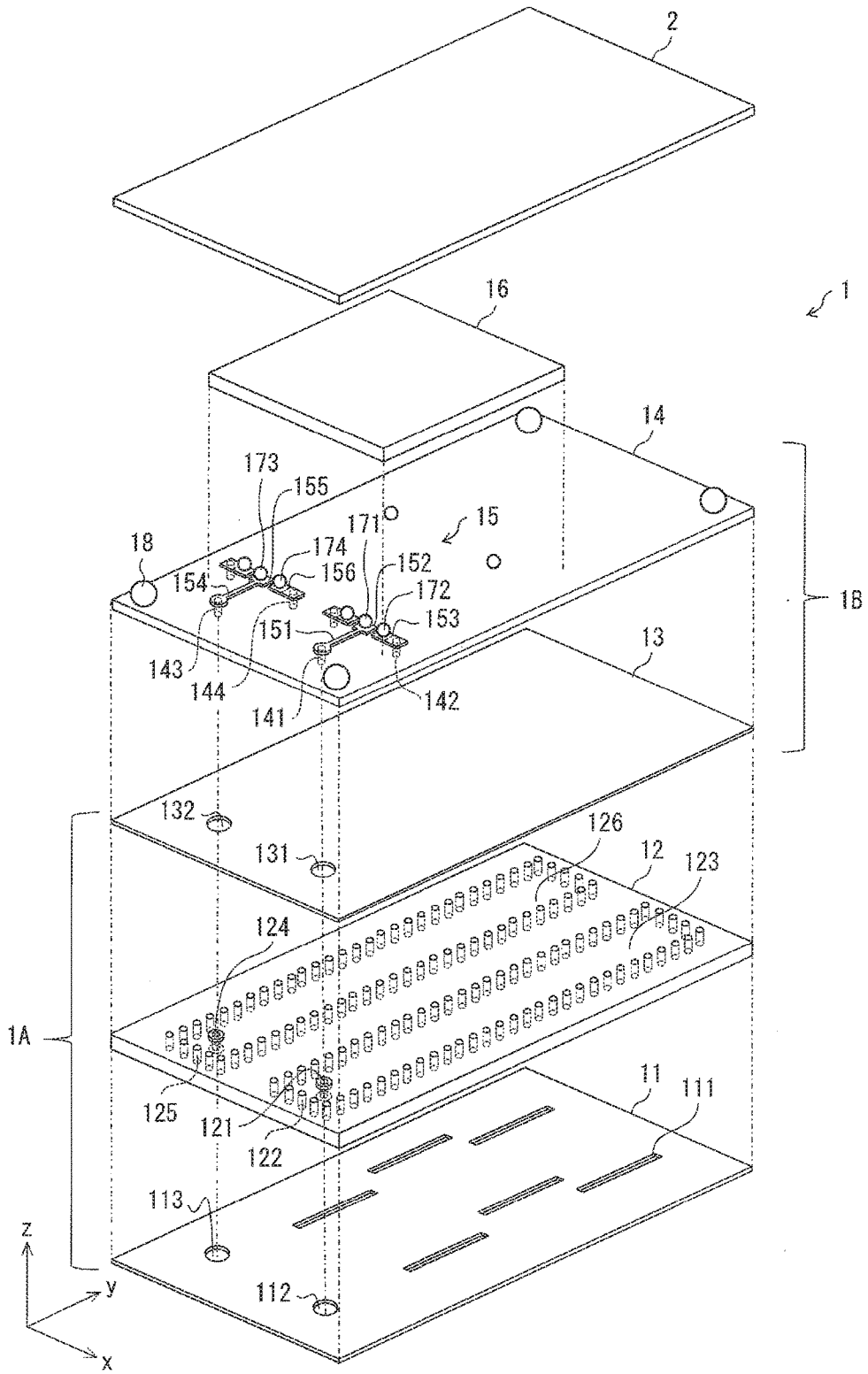
FIG. 1 is an exploded perspective view of an antenna module according to an embodiment of the present invention.
Figure 4:
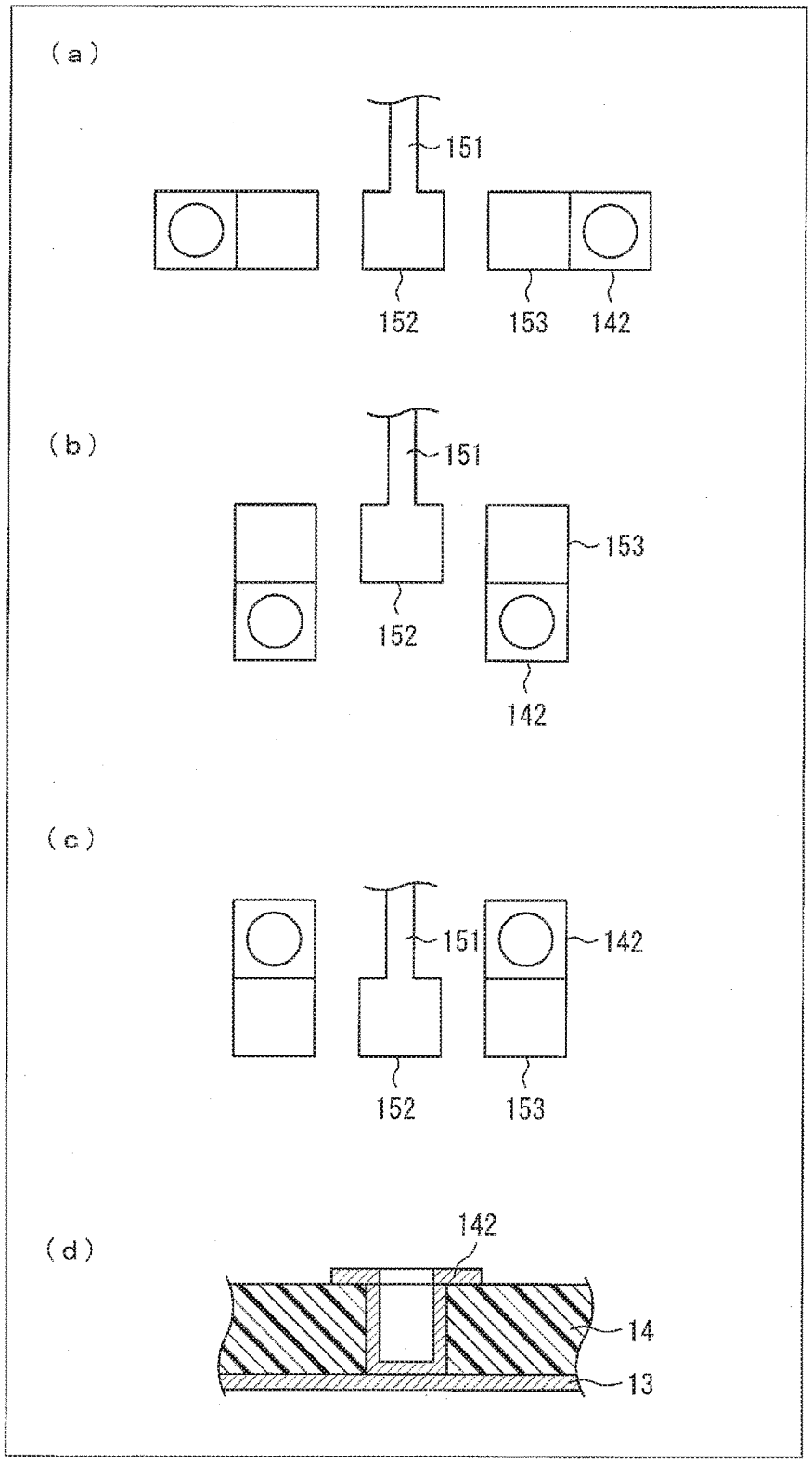

(a) of FIG. 4 is a top view of the antenna module shown in FIG. 1, and shows a position of a grounding via. (b) and (c) of FIG. 4, each related to a respective modification of the antenna module shown in FIG. 1, are top views of antenna modules each including a grounding via that is provided in a position different from that of the antenna module shown in FIG. 1. (d) of FIG. 4 is a cross-sectional view of the antenna module shown in FIG. 1, and shows a configuration of the grounding via.

Figure 5:
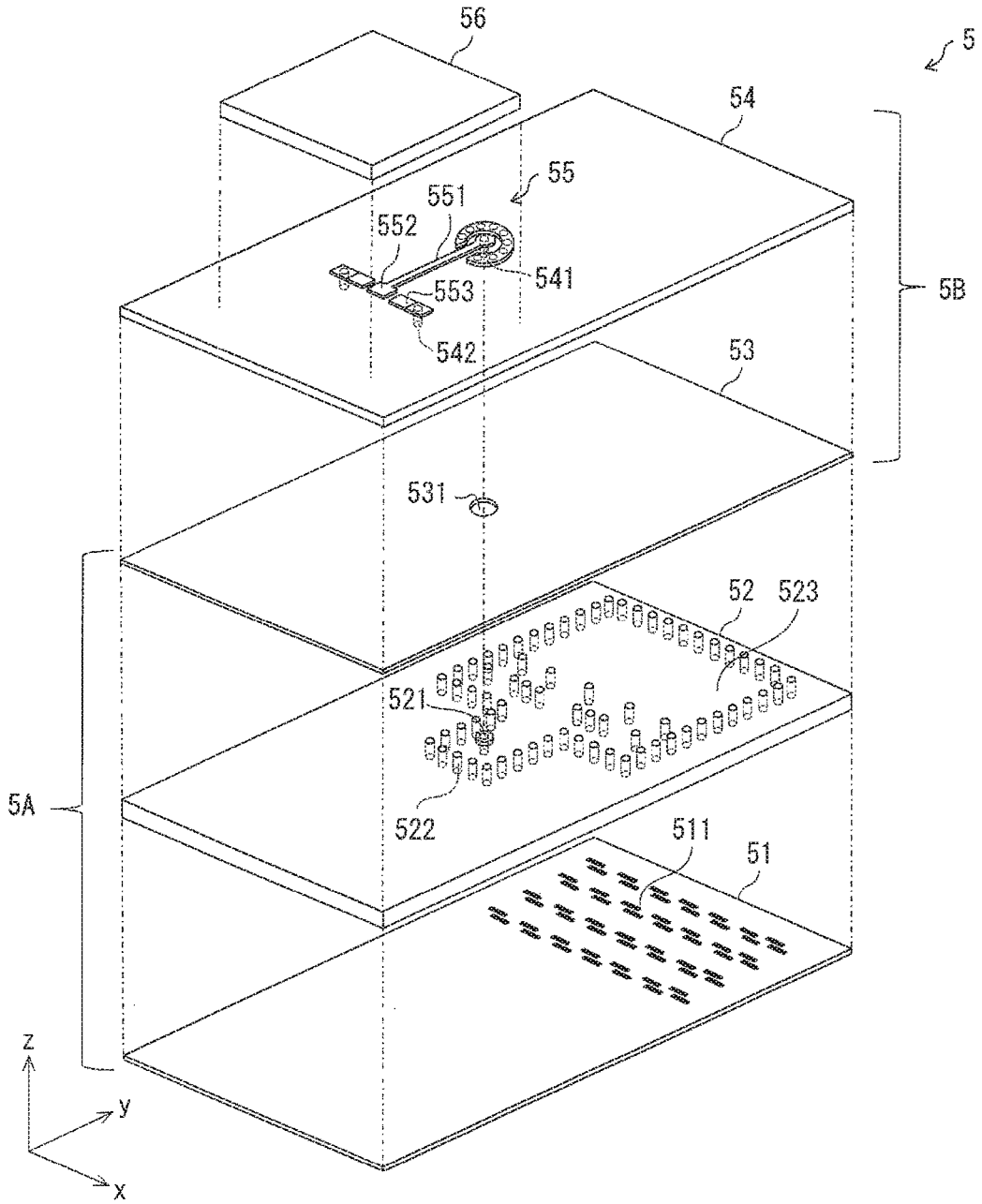

FIG. 5 is an exploded perspective view of a conventional antenna module.

DESCRIPTION OF EMBODIMENT

With reference to the drawings, the following describes an embodiment of an antenna module according to the present invention.

[Configuration of Antenna Module]

First, with reference to FIG. 1, the following describes a configuration of an antenna module 1 of the present embodiment. FIG. 1 is an exploded perspective view of the antenna module 1. Note that FIG. 1 also shows a part of a printed circuit board 2 on which the antenna module 1 is to be mounted.

The antenna module 1 includes a first conductor layer 11, a first dielectric layer 12, a second conductor layer 13, a second dielectric layer 14, a third conductor layer 15, and an RFIC 16, which are stacked in this order.

Each of the first conductor layer 11, the second conductor layer 13, and the third conductor layer 15 may be made from a metal such as copper. The first dielectric layer 12 may be made from glass such as quarts glass, a fluorine-based resin such as PTFE, a liquid crystal polymer, or a cycloolefin polymer. The second dielectric substrate 14 may be made from a fluorine-based resin such as PTFE, a liquid crystal polymer, a cycloolefin polymer, or a polyimide-based resin.

According to the antenna module 1, the first conductor layer 11 and the second conductor layer 13, which face each other via the first dielectric layer 12, constitute a waveguide slot antenna 1A.

The first dielectric layer 12 includes (i) a power feeding pin 121, which serves as a TE mode excitation structure, and (ii) a plurality of posts 122 arranged so as to surround the power feeding pin 121 from four sides. The power feeding pin 121 is a through-hole (i) extending from an upper surface of the first dielectric layer 12 to a lower surface of the first dielectric layer 12 and (ii) having an inner wall to which conductor plating is applied. The first conductor layer 11 has an opening 112 for preventing a lower part of the power feeding pin 121 from coming into contact with the first conductor layer 11. Consequently, the power feeding pin 121 is electrically insulated from the first conductor layer 11. Further, the second conductor layer 13 has an opening 131 for preventing an upper end of the power feeding pin 121 from coming into contact with the second conductor layer 13. Consequently, the power feeding pin 121 is electrically insulated also from the second conductor layer 13. Meanwhile, each of the posts 122 is a through-hole (i) extending from the upper surface of the first dielectric layer 12 to the lower surface of the first dielectric layer 12 and (ii) having an inner wall to which conductor plating is applied. Each of the posts 122 has (i) an upper end which is in contact with the second conductor layer 13 and (ii) a lower end which is in contact with the first conductor layer 13, and thus the first conductor layer 11 and the second conductor layer 13 are short-circuited to each other via the posts 122. With this arrangement, a region whose six sides are surrounded by the first conductor layer 11, the second conductor layer 13, and a post wall constituted by the plurality of posts 122 functions as a first waveguide 123 that guides an electromagnetic wave of TE mode.

The first dielectric layer 12 further includes (i) a power feeding pin 124, which serves as a TE mode excitation structure, and (ii) a plurality of posts 125 arranged so as to surround the power feeding pin 124 from four sides. The power feeding pin 124 is a through-hole (i) extending from the upper surface of the first dielectric layer 12 to the lower surface of the first dielectric layer 12 and (ii) having an inner wall to which conductor plating is applied. The first conductor layer 11 has an opening 113 for preventing a lower end of the power feeding pin 124 from coming into contact with the first conductor layer 11. Consequently, the power feeding pin 124 is electrically insulated from the first conductor layer 11. Further, the second conductor layer 13 has an opening 132 for preventing an upper end of the power feeding pin 124 from coming into contact with the second conductor layer 13. Consequently, the power feeding pin 124 is electrically insulated also from the second conductor layer 13. Meanwhile, each of the posts 125 is a through-hole (i) extending from the upper surface of the first dielectric layer 12 to the lower surface of the first dielectric layer 12 and (ii) having an inner wall to which conductor plating is applied. Each of the posts 125 has (i) an upper part which is in contact with the second conductor layer 13 and (ii) a lower end which is in contact with the first conductor layer 13, and thus the first conductor layer 11 and the second conductor layer 13 are short-circuited to each other via the posts 125. With this arrangement, a region whose six sides are surrounded by the first conductor layer 11, the second conductor layer 13, and a post wall constituted by the plurality of posts 125 functions as a second waveguide 126 that guides an electromagnetic wave of TE mode.

According to the antenna module 1, the first waveguide 123 is used as a waveguide for a sending antenna, whereas the second waveguide 126 is used as a waveguide for a reception antenna. In sending operation, a high frequency signal outputted from the RFIC 16 is transmitted through a microstripline 1B (described later) as an electromagnetic wave of TEM mode, and is then converted into an electromagnetic wave of TE mode by the power feeding pin 121. The electromagnetic wave is guided through the first waveguide 123, and then is emitted outside the waveguide 123 via slots 111 formed in the first conductor layer 11. On the other hand, in receiving operation, an electromagnetic wave entering the inside of the waveguide 126 via the slots 111 formed in the first conductor layer 11 is guided through the first waveguide 12 as an electromagnetic wave of TE mode, and is then converted into an electromagnetic wave of TEM mode by the power feeding pin 124. The electromagnetic wave is transmitted through the microstripline 1B (described later), and is then inputted to the RFIC 16 as a high frequency signal.

In the antenna module 1, the second conductor layer 13 and the third conductor layer 15, which face each other via the second dielectric layer 14, constitute the microstripline 1B. (The second conductor layer 13 is shared by the waveguide slot antenna 1A and the microstripline 1B.)

The third conductor layer 15 is a conductor pattern printed on a surface of the second dielectric layer 14. The third conductor layer 15 includes a signal line 151, a signal pad 152, and a grounding pad 153. The signal line 151 is a linear electric conductor having one end which is connected to an upper end of a power feeding pin 141 formed in the second dielectric layer 14. The power feeding pin 141 is a through-hole (i) extending from an upper surface of the second dielectric layer 14 to a lower surface of the second dielectric layer 14 and (ii) having an inner wall to which conductor plating is applied. The power feeding pin 141 has a lower end which is in contact with the upper end of the power feeding pin 121 formed in the first dielectric layer 12, and thus the signal line 151 and the power feeding pin 121 are electrically conducted with each other via the power feeding pin 141. The signal pad 152 is a square planar electric conductor having a side which is connected to the other end of the signal line 151. The grounding pad 153 is a square planar electric conductor disposed in the vicinity of the single pad 152 but apart from the signal pad 152. The second dielectric layer 14 includes a grounding via 142 formed therein. The grounding via 142 is a through-hole (i) extending from the upper surface of the second dielectric layer 14 to the lower surface of the second dielectric layer 14 and (ii) having an inner wall to which conductor plating is applied. The grounding via 142 has (i) an upper end which is in contact with the grounding pad 153 and (ii) a lower end which is in contact with the second conductor layer 13.

The third conductor layer 15 further includes a signal line 154, a signal pad 155, and a grounding pad 156. The signal line 154 is a linear electric conductor having one end which is connected to an upper end of a power feeding pin 143 formed in the dielectric layer 14. The power feeding pin 143 is a through-hole (i) extending from the upper surface of the second dielectric layer 14 to the lower surface of the second dielectric layer 14 and (ii) having an inner wall to which conductor plating is applied. The power feeding pin 143 has a lower end which is in contact with the upper end of the power feeding pin 124 formed in the first dielectric layer 12, and thus the signal line 154 and the power feeding pin 124 are electrically conducted with each other via the power feeding pin 143. Further, the signal pad 155 is a square planar electric conductor having a side which is connected to the other end of the signal line 154. The grounding pad 156 is a square planar electric conductor disposed in the vicinity of the signal pad 155 but apart from the signal pad 155. The second dielectric layer 14 has a grounding via 144 formed therein. The grounding via 144 is a through-hole (i) extending from the upper surface of the second dielectric layer 14 to the lower surface of the second dielectric layer 14 and (ii) having an inner wall to which conductor plating is applied. The grounding via 144 has (i) an upper end which is in contact with the grounding pad 156 and (ii) a lower end which is in contact with the second conductor layer 13. The grounding vias 142 and 144 allow the second conductor layer 13 and the first conductor layer 11, which is short-circuited to the second conductor layer 13, to have the same electric potential (grounding potential) as that of the grounding pads 153 and 156.

The signal pad 152 is bump-connected, via a solder bump 171, with a signal terminal for sending (not illustrated) formed on a back surface of the RFIC 16. Further, the grounding pad 153 is bump-connected, via a solder bump 172, a grounding terminal (not illustrated) formed on the back surface of the RFIC 16. This arrangement allows, in sending operation, a high frequency signal generated by the RFIC 16 to be supplied to the waveguide slot antenna 1A without causing a signal reflection due to a parasitic inductance. Further, the signal pad 155 is bump-connected, via a solder bump 173, with a signal terminal for reception (not illustrated) formed on the back surface of the RFIC 16. Further, the grounding pad 156 is bump-connected, via a solder bump 174, with a grounding terminal (not illustrated) formed on the back surface of the RFIC 16. This arrangement allows, in receiving operation, a high frequency signal generated by the waveguide slot antenna 1A to be supplied to the RFIC 16 without causing a signal reflection due to a parasitic inductance.

A remarkable point of the antenna module 1 is that the RFIC 16 is disposed so as to overlap the waveguides 123 and 126 as viewed in a stacking direction (i.e., as viewed in a z-axis positive direction in FIG. 1). As a result, an area of the antenna module 1 as viewed in the stacking direction, i.e., an area required for mounting the antenna module 1, is smaller than a sum of (i) an area of the RFIC 16 as viewed in the stacking direction and (ii) respective areas of the waveguides 123 and 126 as viewed in the stacking direction. That is, an area required for mounting the antenna module 1 of the present embodiment is smaller than an area required for mounting the conventional antenna module 5.

The antenna module 1 is free from an apprehension that antenna characteristics are changed by capacity coupling with the RFIC 16. This is because that the second conductor layer 13 is interposed between the RFIC 16 and the first conductor layer 111, in which the slots 111 are formed. According to the antenna module 1, an electromagnetic wave propagating in a z-axis negative direction is emitted from the slots 11 in sending operation, whereas an electromagnetic wave propagating in the z-axis positive direction enters the slots 11 in receiving operation. However, the antenna module 1 is free from an apprehension that (i) such an electromagnetic wave is disturbed by the RFIC 16 or (ii) the function of the RFIC 16 is impaired by such an electromagnetic wave. The reason for this is as follows. That is, such an electromagnetic wave propagates through a space on the lower surface side of the waveguide slot antenna 1A (i.e., on the z-axis negative direction side in FIG. 1), whereas the RFIC 16 is disposed in a space on the upper surface side of the waveguide slot antenna 1A (i.e., on the z-axis negative positive direction side of the z axis in FIG. 1). According to this arrangement, the waveguide slot antenna 1A can be designed without consideration of the existence or absence of the RFIC 16. Further, according to this arrangement, the characteristics of the waveguide slot antenna 1A are not influenced by the RFIC 16.

In order to dispose the RFIC 16 as described above, the antenna module 1 is configured such that (i) the signal line 151 is drawn from the upper end of the power feeding pin 141 toward a center of the waveguide 123 (i.e., in a y-axis positive direction in FIG. 1) and (ii) the signal line 154 is drawn from the upper end of the power feeding pin 143 toward a center of the waveguide 126 (i.e., in the y-axis positive direction in FIG. 1). Also in this point, the antenna module 1 is different from the conventional antenna module 5.

As shown in FIG. 1, the antenna module 1 is mounted on the printed circuit board 2. The mounting is carried out in the following manner. That is, (i) the third conductor layer 15 of the antenna module 1 and (ii) a module mounting pad (not illustrated) of the printed circuit board 2 are bump-connected with each other via solder bumps 18, which are formed in advance on the antenna module 1 or on the printed circuit board 2.

[Cross-Sectional Structure of Antenna Module]

Figure 2:
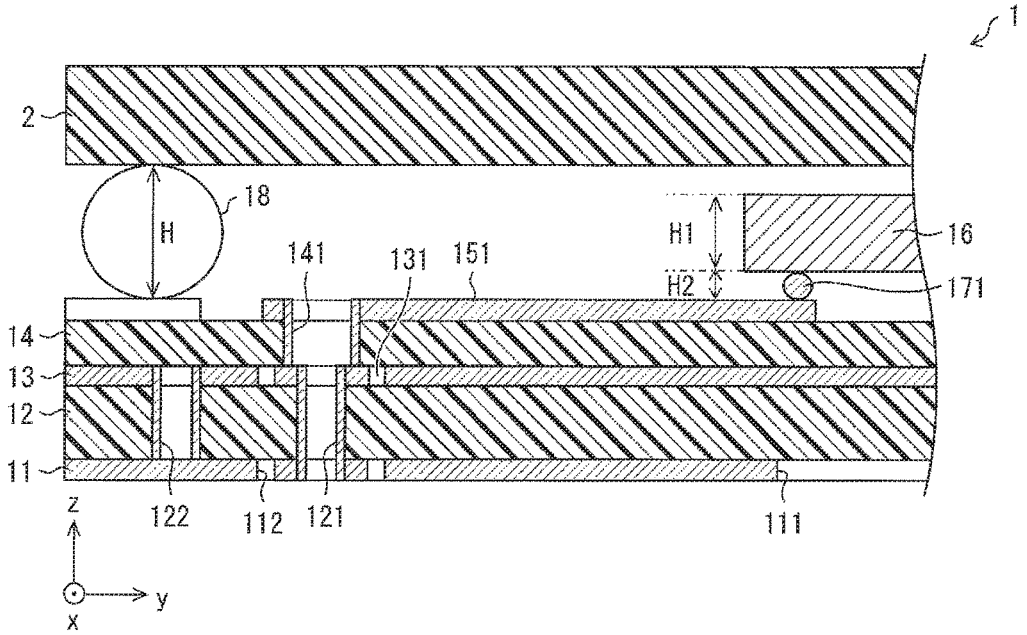
FIG. 2 is a cross-sectional view of the antenna module shown in FIG. 1, and shows configurations of a power feeding pin and a post.

Next, with reference to FIG. 2, the following describes structures of the power feeding pins 121 and 141 and the posts 122 included in the antenna module 1 shown in FIG. 1. FIG. 2 is a cross-sectional view of the antenna module 1. Note that FIG. 2 shows, among cross sections in parallel with a yz plane of the antenna module 1 (see FIG. 1), a cross section including the power feeding pins 121 and 141 and one of the posts 122. Note also that FIG. 2 shows a part of the printed circuit board 2, on which the antenna module 1 is mounted.

As shown in FIG. 2, the antenna module 1 is configured such that the power feeding pins 121 and 141 constitute a continuous through-hole extending from the upper surface of the second dielectric layer 14 to the lower surface of the first dielectric layer 12. The power feeding pins 121 and 141 are produced by (i) applying conductor plating to the inner walls of the through-holes respectively formed in the first dielectric layer 12 and the second dielectric layer 14 and then (ii) stacking the two through-holes.

Remarkable points of the power feeding pins 121 and 141 shown in FIG. 2 are that (1) the upper end of the power feeding pin 141 is in contact with the signal line 151, (2) the upper end of the power feeding pin 121 is apart from the second dielectric layer 13 thanks to the opening 131, and (3) the lower end of the power feeding pin 121 is apart from the first dielectric layer 11 thanks to the opening 112. With this arrangement, the power feeding pin 121 is electrically conducted with the signal line 151, and is electrically insulated from both of the first conductor layer 11 and the second conductor layer 13.

Further, as shown in FIG. 2, the antenna module 1 is configured such that the post 122 is made of a through-hole extending from the upper surface of the first dielectric layer 12 to the lower surface of the first dielectric layer 12. The post 122 is produced by applying conductor plating to the inner wall of the through-hole formed in the first dielectric layer 11.

Remarkable points of the post 122 shown in FIG. 2 are that (1) the upper end of the post 122 in contact with the second dielectric layer 13 and (2) the lower surface of the post 122 is in contact with the first conductor layer 11. With this arrangement, the post 122 is electrically conducted with both of the first conductor layer 11 and the second conductor layer 13, and the first conductor layer 11 and the second conductor layer 13 are short-circuited to each other.

Another remarkable point in FIG. 2 is that the solder bump 18 via which the antenna module 1 is bump-connected to the printed circuit board 2 has a height H which is greater than a sum of H1+H2, where (i) "H1" stands for a height H1 of the solder bump 171 via which the RFIC 16 is bump-connected to the signal line 151 and (ii) "H2" stands for a thickness H2 of the RFIC 16. This makes it possible to prevent a lower surface of the printed circuit board 2 and an upper surface of the RFIC 16 from coming into contact with each other.

As shown in FIG. 2, the present embodiment is arranged such that the power feeding pin 121 is made of the through-hole extending from the upper surface of the first dielectric layer 12 to the lower surface of the first dielectric layer 12. However, the present invention is not limited to this. Alternatively, as shown in FIG. 3, a power feeding pin 121 may be made of a non-through-hole extending from the upper surface of the first dielectric layer 12 to an inside of the first dielectric layer 12, rather than to the lower surface of the first dielectric layer 12.

Figure 3:
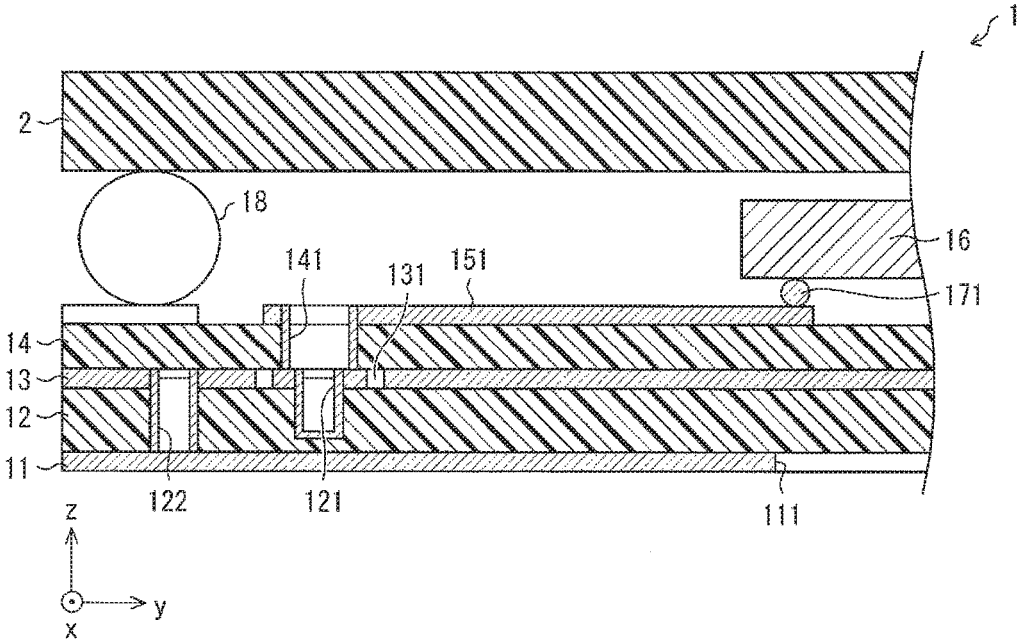
FIG. 3, related to a modification of the antenna module shown in FIG. 1, is a cross-sectional view of an antenna module including a power feeding pin whose configuration is different from that of the antenna module shown in FIG. 1.

Remarkable points of the power feeding pins 121 and 141 shown in FIG. 3 are that (1) the upper end of the power feeding pin 141 is in contact with the signal line 151, (2) the upper end of the power feeding pin 121 is apart from the second conductor layer 13 thanks to the opening 131, and (3) the lower end of the power feeding pin 121 is inside the first dielectric layer 12 and thus is apart from the first conductor layer 11. With this arrangement, the power feeding pin 121 is electrically conducted with the signal line 151, and is electrically insulated from both of the first conductor layer 11 and the second conductor layer 13.

Use of the through-hole shown in FIG. 2 as the power feeding pin 121 brings an advantage to make it easier to form such a through-hole, as compared with an arrangement in which the non-through-hole shown in FIG. 3 is used. On the other hand, use of the non-through-hole shown in FIG. 3 as the power feeding pin 121 brings an advantage to prevent leakage of an electromagnetic wave through the opening 112 more reliably, as compared with an arrangement in which the through-hole shown FIG. 2 is used.

Although use of the through-hole shown in FIG. 2 as the power feeding pin 121 may lead to leakage of an electromagnetic wave through the opening 112, the function of the RFIC will not be impaired by the leaked electromagnetic wave because the RFIC 16 is shielded by two conductor layers 11 and 13 from a space through which the leaked electromagnetic wave propagates.

[Position of Grounding Via]

Next, with reference to (a) of FIG. 4, the following describes a position of the grounding via 142 included in the antenna module 1 shown in FIG. 1. (a) of FIG. 4 is a top view of the antenna module 1.

The antenna module 1 is arranged as shown in (a) of FIG. 4. That is, the grounding via 142 is positioned so that the upper end of the grounding via 142 is adjacent to a side of the grounding pad 153, the side being opposite to another side of the grounding pad 153, the another side facing the signal pad 152.

Note that the position of the grounding via 142 only needs to be selected in accordance with the position of the terminal in the RFIC 16, and is not limited to the position shown in (a) of FIG. 4. Namely, as shown in (b) of FIG. 4, the grounding via 142 may be positioned such that the upper end of the grounding via 142 is adjacent to a side of the grounding pad 153, the side being on a side of a direction opposite to the direction in which the signal line 151 is drawn (i.e., on the y-axis negative direction side in FIG. 1). Alternatively, as shown in (c) of FIG. 4, the grounding via 142 may be positioned such that the upper end of the grounding via 142 is adjacent to a side of the grounding pad 153, the side being on a side of the direction opposite to the direction in which the signal line 151 is drawn (i.e., on the y-axis negative direction side FIG. 1)

The grounding via 142 may be a through-hole extending from the upper surface of the second dielectric layer 14 to the lower surface of the second dielectric layer 14, as those shown in FIG. 4. The through-hole has an inner wall to which conductor plating is applied, which allows the grounding pad 153 and the second conductor layer 13 to be short-circuited to each other. This allows the second conductor layer 13 (and the first conductor layer 11, which is short-circuited to the second conductor layer 13) to have the same electric potential (grounding potential) as that of the grounding pad 153.

SUMMARY

An antenna module of the present embodiment includes: a waveguide slot antenna including a first conductor layer and a second conductor layer facing each other via a first dielectric layer, the first conductor layer having an opening serving as a slot; a microstripline including the second conductor layer and a third conductor layer facing each other via a second dielectric layer; and a radio frequency integrated circuit being connected to the third conductor layer, the radio frequency integrated circuit being disposed so as to overlap a waveguide in the waveguide slot antenna as viewed in a stacking direction of the layers.

According to the above arrangement, an area of the antenna module of the present invention as viewed in the stacking direction, i.e., an area required for mounting the antenna module of the present invention, is smaller than a sum of (i) an area of the RFIC as viewed in the stacking direction and (ii) an area of the waveguide as viewed in the stacking direction. That is, an area required for mounting the antenna module of the present invention is smaller than an area required for mounting a conventional antenna module.

The antenna module of the present embodiment is preferably configured such that the third conductor layer is a conductor pattern including a signal line having one end which is connected to the radio frequency integrated circuit; and the waveguide slot antenna includes, as a TE mode excitation structure, a through-hole (i) extending from an upper surface of the second dielectric layer to a lower surface of the second dielectric layer and (ii) having an inner wall to which conductor plating is applied, the through-hole being insulated from the first and second conductor layers due to respective openings of the first and second conductor layers, and the through-hole being electrically conducted with the other end of the signal line.

According to the above arrangement, the through-hole extending from the upper surface of the second dielectric layer to the lower surface of the second dielectric layer is employed as the TE mode excitation structure. With such a configuration, it is easier to form the TE mode excitation structure, as compared to an arrangement in which a non-through-hole extending from the upper surface of the second dielectric layer to an inside of the second dielectric layer is employed as the TE mode excitation structure.

The antenna module of the present embodiment is preferably configured such that the third conductor layer is a conductor pattern including a signal line having one end which is connected to the radio frequency integrated circuit; and the waveguide slot antenna includes, as a TE mode excitation structure, a non-through-hole (i) extending from an upper surface of the second dielectric layer to an inside of the second dielectric layer and (ii) having an inner wall to which conductor plating is applied, the non-through-hole being electrically insulated from the second conductor layer due to an opening of the second conductor layer, and the non-through-hole being electrically conducted with the other end of the signal line.

According to the above arrangement, the non-through-hole extending from the upper surface of the second dielectric layer to the inside of the second dielectric layer is employed as the TE mode excitation structure. Hence, it is possible to prevent an electromagnetic wave from leaking through the opening in the first conductor layer.

The antenna module of the present embodiment is preferably configured such that the signal line extends from the other end toward a center of the waveguide.

According to the arrangement described above, the antenna module can be made further smaller.

The antenna module of the present embodiment is preferably configured such that the waveguide slot antenna is a post wall waveguide antenna.

By employing the waveguide slot antenna (post wall waveguide antenna) including the waveguide having palisaded side walls (post walls), the antenna module can be made lighter than a conventional waveguide slot antenna including a waveguide having plate-shaped side walls.

Further, a method of the present embodiment for mounting an antenna module is a method for mounting the above-described antenna module on a printed circuit board, the method including the step of: bump-connecting the antenna module to the printed circuit board via a solder bump, the solder bump via which the antenna module is bump-connected to the printed circuit board having a height greater than a sum of (i) a thickness of the radio frequency integrated circuit and (ii) a height of a solder bump via which the radio frequency integrated circuit is bump-connected to the third conductor layer.

According to the above arrangement, it is possible to mount the antenna module on the printed circuit board without bringing the RFIC into contact with the printed circuit board.

[Supplementary Information]

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is suitably applicable to, for example, an antenna module to be mounted in a WiGig-compatible wireless device. However, the application of the present invention is not limited to this. Specifically, the present invention is applicable to general antenna modules each including a waveguide slot antenna and an RFIC in an integrated manner.

REFERENCE SIGNS LIST

1 Antenna module
1A Waveguide slot antenna
1B Microstripline
11 First conductor layer
111 Slot
112, 113 Opening
12 First dielectric layer
121, 124 Power feeding pin
122, 125 Post
123, 126 Waveguide
13 Second conductor layer
131, 132 Opening
14 Second dielectric layer
141, 143 Power feeding pin
142, 144 Grounding via
15 Third conductor layer
151, 154 Signal line
152, 155 Signal pad
153, 156 Grounding pad
171, 172, 173, 174 Solder bump (for mounting RFIC)
18 Solder bump (for mounting printed circuit board)

The invention claimed is:

1. An antenna module comprising:

a waveguide slot antenna including a first conductor layer and a second conductor layer facing each other via a first dielectric layer, the first conductor layer having an opening serving as a slot;

a microstripline including the second conductor layer and a third conductor layer facing each other via a second dielectric layer; and a radio frequency integrated circuit being connected to the third conductor layer, the radio frequency integrated circuit being disposed so as to overlap a waveguide in the waveguide slot antenna as viewed in a stacking direction of the layers, the third conductor layer being a conductor pattern including a signal line having (i) one end which is connected to the radio frequency integrated circuit and (ii) the other end which is connected to a TE mode excitation structure in the waveguide slot antenna, and the signal line extending from the other end toward a center of the waveguide, wherein the microstripline is planar.

2. The antenna module as set forth in claim 1, wherein:

the waveguide slot antenna includes, as the TE mode excitation structure, a through-hole (i) extending from an upper surface of the first dielectric layer to a lower surface of the first dielectric layer and (ii) having an inner wall to which conductor plating is applied, the through-hole being insulated from the first and second conductor layers due to respective openings of the first and second conductor layers, and the through-hole being electrically conducted with the other end of the signal line.

3. The antenna module as set forth in claim 1, wherein:

the third conductor layer is the conductor pattern including the signal line having the one end which is connected to the radio frequency integrated circuit; and the waveguide slot antenna includes, as the TE mode excitation structure, a non-through-hole (i) extending from an upper surface of the first dielectric layer to an inside of the first dielectric layer and (ii) having an inner wall to which conductor plating is applied, the non-through-hole being electrically insulated from the second conductor layer due to an opening of the second conductor layer, and the non-through-hole being electrically conducted with the other end of the signal line.

4. The antenna module as set forth in claim 1, wherein the waveguide slot antenna is a post wall waveguide antenna.

5. A method for mounting, on a printed circuit board, an antenna module as set forth in claim 1, comprising the step of:

bump-connecting the antenna module to the printed circuit board via a solder bump, the solder bump via which the antenna module is bump-connected to the printed circuit board having a height greater than a sum of (i) a thickness of the radio frequency integrated circuit and (ii) a height of a solder bump via which the radio frequency integrated circuit is bump-connected to the third conductor layer.

6. The antenna module as set forth in claim 1, wherein the second conductor layer is a ground plane of the microstrip-line.

* * * * *